United States Patent [19]

Galinou

[11] 4,419,954

[45] Dec. 13, 1983

[54] DEVICE FOR APPLYING A COATING TO A SURFACE SUBMERGED IN A LIQUID

[75] Inventor: Raymond Galinou, Veigne, France

[73] Assignees: Commissariat a l'Energie Atomique; Centre National pour l'Exploitation des Oceans, both of Paris, France

[21] Appl. No.: 378,788

[22] Filed: May 17, 1982

[30] Foreign Application Priority Data

May 22, 1981 [FR] France ..... 81 10224

[51] Int. Cl.[3] ..... B05C 1/02

[52] U.S. Cl. ..... 118/207; 118/410; 118/256; 114/222

[58] Field of Search ..... 118/207, 264, 305, 410, 118/108, 256; 114/222; 15/98; 401/139

[56] References Cited

U.S. PATENT DOCUMENTS 2,521,817 9/1950 Andresen et al. ..... 118/264
4,058,082 11/1977 Winn ..... 118/207 X
4,079,694 3/1978 Galinou ..... 118/207

FOREIGN PATENT DOCUMENTS 2355574 1/1978 France .
2369010 5/1978 France .

*Primary Examiner*—John P. McIntosh
*Attorney, Agent, or Firm*—Pearne, Gordon, Sessions, McCoy, Granger & Tilberry

[57] ABSTRACT

A device for applying a coating to a submerged surface. This device comprises an applicator having a support plate and a tight deformable envelope provided on is outer face with bristles, springs being fixed to the inner face of the plate and exert a pressure on the inner face of the envelope. The applicator is connected to the rigid support by means of a group of articulated rods, thereof at least one is connected to the support by elastic means in order that the applicator is applied with an adequate pressure to the surface. Application to the painting of the hulls of ships.

3 Claims, 1 Drawing Figure

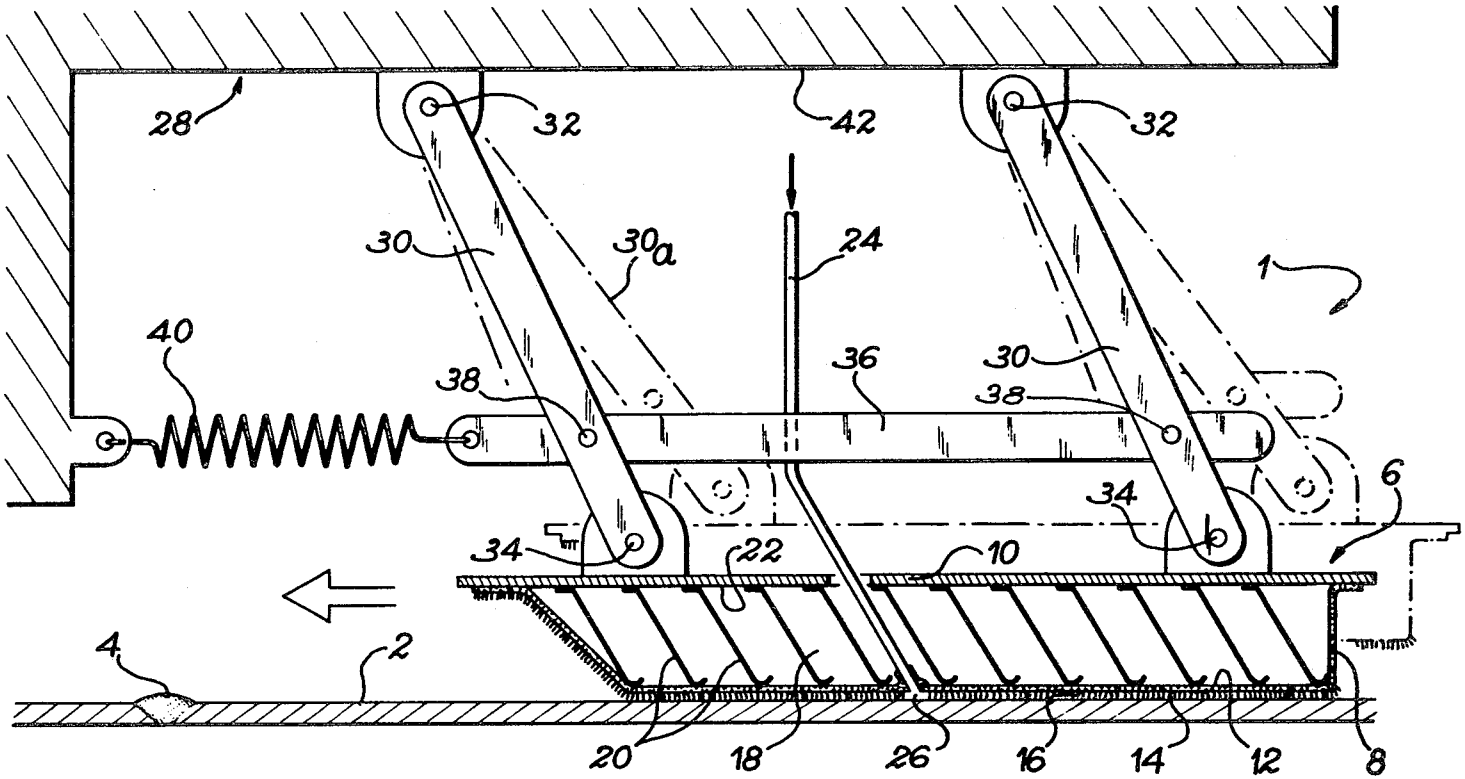
1
6
8
12
14
16
26
18
20
2
4
10
22
34
34
32
32
30
30a
38
38
36
24
42
28
40

DEVICE FOR APPLYING A COATING TO A SURFACE SUBMERGED IN A LIQUID

BACKGROUND OF THE INVENTION

The present invention relates to devices for applying a coating to a surface submerged in a liquid, making it possible to continuously paint in water large submerged areas, such as the hulls of ships. It more specifically relates to a device making it possible to absorb both small defects in the surface to be painted (small protuberances or pits) and larger defects (protuberances and pits, whose size can be several centimeters per meter).

A certain number of devices for painting a submerged surface have already been proposed. French Pat. No. 2,333,583, filed on Dec. 1st 1975 by the Applicants, describes such a device. In general terms, this device comprises means for spreading the coating onto the surface and which move along the latter, as well as means making it possible to exert a given pressure on the spreading means in order to expel the water from the surface to be coated as the displacement advances. According to a first variant, the spreading means are constituted by a cylindrical roller applied to the surface to be coated, whilst the paint supply is provided by a pipe issuing immediately in front of the roller. In a second variant, the spreading means are constituted by a group of rotary disks, the surface of each of these disks which is in contact with the surface to be coated being covered with bristles. The paint is supplied by pipes issuing into a central opening made in each of the disks. In a third variant, the spreading means are constituted by a spatula having two lips, the front lip being hollow. A pressurized gas jet issues into the cavity defined by the front hollow lip in order to remove the water from the surface to be coated, whilst the paint enters the rear cavity located between the two lips. These different devices are applied to the submerged surface, either by means of jacks, or by means of springs.

French Pat. No. 2,184,352 describes a system which also uses one or more rotary brushes having in their central part hard bristles which are used for further removing the water from the surface to be painted, and on the periphery more flexible bristles for smoothing the paint.

These various arrangements have a certain number of disadvantages, particularly with regards to the rotary brushes. Thus, the rotation speed must be sufficiently high to remove the water from the surface to be painted, but if the speed is too high there is also a risk of removing the paint and it is very difficult to find a satisfactory compromise.

Certificate of Addition BF No. 2,369,010 to French Pat. No. 2,333,583, filed on October 26th 1976 in the name of the Applicants, describes an improvement to these devices aiming at improving the coating application conditions, whilst permitting a better adaptation to surface irregularities and a better adhesion of the coating. In a first variant, the paint spreading means are constituted by a roller comprising an outer envelope surrounding a flexible material having an alveolar or honeycomb structure. The outer surface of the envelope is provided with bristles, whilst the alveolar structure of the inner material enables the water to penetrate the latter, in order that the internal pressure is equal to the external pressure, no matter what the immersion depth. The paint is still supplied by a pipe issuing immediately in front of the roller. In a second variant, the roller is replaced by a pad and only its surface in contact with the surface to be painted is covered with bristles. The pad also has an outer envelope surrounding a flexible material having an alveolar structure. In both cases, the flexibility of the tight envelope and of the internal material enables the device to easily absorb surface defects during its displacement.

However, although these devices make it possible to absorb small surface defects in the form of protuberances, such as weld beads, the alveolar flexible material cannot deform adequately to absorb small pits or cavities and these devices are also unable to absorb larger defects called "defects of form" in the remainder of the present text and which are constituted e.g. by sheet metal defects in the form of protuberances or pits over several centimeters per meter. In addition, use has demonstrated that it was not possible to prevent the penetration of paint and its solvents into the interior of the open honeycomb cavities of the inner material of the pads. In operation, and particularly during cleaning, the solvents and the paint enter the pad, which leads to a rapid deterioration of the materials.

Finally, French Pat. No. 2,355,574 describes a device having rotary brushes actuated by motors, themselves connected to a support by leaf springs. Apart from the faults inherent in rotary brushes mentioned hereinbefore, the leaf springs only permit small amplitude movements and this device does not make it possible to absorb large defects of form.

BRIEF SUMMARY OF THE INVENTION

The present invention relates to a device, which obviates the above disadvantages, whilst being able to absorb both small defects in protuberance or pit form and defects of form.

According to the main feature of the device according to the invention, said device is of the type which comprise at least one applicator moving along the surface to be painted and constituted by a pad having a support plate and a tight deformable envelope, the plate and the envelope having in each case an inner face and an outer face, the latter being in contact with the liquid in which the surface to be painted is submerged, the envelope being provided on its outer face with flexible fibers or bristles for rubbing on said surface, the support plate and deformable envelope having such that they define a space within the pad, the latter being associated with a rigid support cooperating with means making it possible to exert a given pressure on the surface, wherein the space within the pad is tight to the liquid in which the surface to be painted is submerged and is equipped with elastic means making it possible to locally deform the envelope and wherein the said means making it possible to exert a given pressure on the surface comprise a deformable system connecting the pad to the rigid support in order that the relative position of support and pad can vary, whilst the latter remains applied against the surface to be painted.

Thus, the invention solves the problem of absorbing both small surface defects and larger defects of form, as a result of the combined and simultaneous action of the deformable parallelogram enabling the applicator to remain in contact with the surface to be painted, even if the latter has protuberances and pits, and elastic means permitting the envelope of the applicator to locally deform in order to adapt to the shape of the small surface defects, no matter whether the latter are in protuberance or pit form. Moreover, as the space within the pad is tight and only contains the elastic means, it is possible to eliminate all the disadvantages due to the penetration of the paint and its solvents into the alveolar material. The term "small defects" is understood to mean defects in protuberance or pit form, whose dimensions are smaller than those of the pad and it is in this sense that this term is used throughout the remainder of the text.

According to a preferred embodiment of the device according to the invention, the elastic means permitting the local deformation of the envelope of the pad comprise springs, whereof one end is fixed to the inner face of the plate and whose other end exerts a pressure on the inner face of the plate.

According to another feature of the device, the deformable system comprises a deformable parallelogram having a group of rods connecting the applicator to the support by means of articulations in order that the relative position of applicator and support can vary as a function of surface defects of form, at least one supplementary rod connected to the aforementioned rods by articulations and means enabling the application to the deformable parallelogram of a force directed in the displacement direction of the paint applicator in order to exert an adequate pressure to apply the latter to the surface to be painted.

According to a preferred embodiment of the invention, the means making it possible to exert a force on the deformable parallelogram comprise a spring connecting the supplementary rod to the rigid support.

DESCRIPTION OF THE DRAWING AND PREFERRED EMBODIMENTS

The FIGURE of the drawing shows a cross-sectional view of the applicator device.

Further details of the invention can be gathered from the following description given in an illustrative and non-limitative manner, with reference to the attached drawing, which is a diagrammatic view, partly in section, of the device according to the invention.

The drawing shows the complete device 1, which moves along a surface 2, which can have defects or irregularities such as the weld bead 4. The applicator 6 is in the form of a pad having a tight envelope 8 fixed to the support plate 10. The envelope has an inner face 12 and an outer face 14 to which are fixed the flexible bristles 16 making it possible to spread the coating on surface 2. For example, they can be constituted by nylon fibers deposited by flocking. The shape of envelope 8 is such that it defines with plate 10 a space 18 within pad 6. It is also possible to see a group of springs 20 constituted by flexible metal laminations, whereof one end is fixed to the inner face 22 of the plate 10, whilst the other curved end exerts a pressure on the inner face 12 of envelope 8. The material forming the latter is sufficiently flexible to deform under the action of the springs, when the pad encounters surface defects during its displacement. The number and arrangement of the springs permit local deformations of the flexible envelope 8, both towards the inside and towards the outside of pad 6 and in this way it is possible to absorb both small pits and small protuberances, such as the weld bead 4. The paint is supplied by a system of pipes 24 issuing onto the outer surface of envelope 8 through openings 26. The bristles located to the front of opening 26 (movement taking place in the direction of the arrow) serve to remove the water from the surface to be coated during displacements, whilst the paint is spread by bristles located to the rear of this opening.

The drawing also shows the device connecting pad 6 to rigid support 28. In the embodiment described here, this connection is ensured by a group of rods forming an articulated parallelogram. It is possible to see two rods, such as 30 connected on the one hand to rigid support 28 by articulations 32 fixed to one face 42 of said support and on the other hand to pad 6 by articulations 34. A third rod 36, substantially parallel to support plate 10 is connected to the first rods 30 by articulations 38. The drawing also shows elastic means 40, in the present case a helical spring, connecting rod 36 to the rigid support 28.

Thus, if during its displacement the device encounters defects of form on surface 2, the parallelogram formed by rods 30, rod 36 and the line passing through the articulations 32 deforms, which makes it possible to vary the relative position of the pad and the support 28 as a function of the obstacles encountered. For example, in the case of a protuberance, the pad lifts and rods 30 occupy a position **30*a* shown in phantom lines in the drawing. Rod 36 is driven to the right, which leads to the extension of spring 40. On clearing the protuberance, the assembly returns to its initial position under the action of the tension of spring 40, whose presence makes it possible to apply pad 6 to the surface with a constant pressure. This arrangement makes it possible to vary the relative position of pad 6 and support 28 within wide limits and consequently to easily absorb large defects of form (protuberances or pits of several centimeters per meter). The action of the rods and of spring 40 is completed by that of springs 20 enabling the flexible envelope 8 to adapt to small defects on surface 2**.

Thus, the combined action of on the one hand the parallelogram formed by rods 30, 36 and support 28 and maintained by spring 40, as well as on the other hand springs 20 permitting the deformation of envelope 8, makes it possible to simultaneously absorb defects of form or large faults, as well as small defects such as weld beads.

The device according to the invention has particularly interesting advantages because it makes it possible to absorb both small surface defects and larger defects, e.g. pits and protuberances in sheet metal. Moreover, there is no risk of the alveolar material filling the interior of the pad deteriorating under the action of paint or solvents, because it is replaced by a group of metal springs and the space within the pad is tight. Tests on a prototype have revealed that an adequate and substantially constant pressure is obtained for applying the pad to a surface having defects of form of approximately 3 cm/m.

The device according to the invention has numerous and varied applications, which are not limited to submerged surfaces. Although the device has more particularly been designed for painting the hulls of ships, it can also be used for surfaces in the open air, e.g. large surfaces on the ground and having defects of varying size. Prototype tests have revealed that such a device is able to deal with about 600 $m^2$/hour.

What is claimed is:

1. A device for applying a coating to a surface submerged in a liquid comprising, at least one applicator moving along the surface to be painted and constituted by a pad having a support plate and a tight deformable envelope, the plate and the envelope having in each case an inner face and an outer face, the latter being in contact with the liquid in which the surface to be painted is submerged, the envelope being provided on its outer face with flexible fibres or bristles for rubbing on said surface, the support plate and deformable envelope defining a space within the pad, the latter being associated with a rigid support co-operating with means making it possible to exert a given pressure on the surface, wherein the space within the pad is tight to the liquid in which the surface to be painted is submerged and is equipped with elastic means making it possible to locally deform the envelope, and wherein the said means making it possible to exert a given pressure on the surface comprise a deformable system connecting the pad to the rigid support in order that the relative position of support and pad can vary, whilst the latter remains applied against the surface to be painted, the elastic means permitting the local deformation of the envelope of the pad comprising springs, whereof one end of each spring is fixed to the inner face of the plate, the other end thereof exerting a pressure on the inner face of the envelope.

2. A device according to claim 1, wherein the deformable system comprises a deformable parallelogram having a group of rods connecting the applicator to the support by means of articulations in order that the relative position of applicator and support can vary as a function of surface defects of form, at least one supplementary rod connected to the aforementioned rods by articulations and means enabling the application to the deformable parallelogram of a force directed in the displacement direction of the paint applicator in order to exert an adequate pressure to apply the latter to the surface to be painted.

3. A device according to claim 2, wherein the means making it possible to exert a force on the deformable parallelogram comprise a spring connecting the supplementary rod to the rigid support.

* * * * *